US005813955A

United States Patent [19]

Gutkowski et al.

[11] Patent Number: 5,813,955

[45] Date of Patent: Sep. 29, 1998

[54] AEROBIC EXERCISE DEVICE

[76] Inventors: Thaddeus Edward Gutkowski, 702 Summit St., Linden, N.J. 07036; Roland John Olney, 4 Victoria Grove, Ferny Creek, Victoria, Australia, 3786

[21] Appl. No.: 891,900

[22] Filed: Jul. 14, 1997

Related U.S. Application Data

[63] Continuation of Ser. No. 567,531, Dec. 5, 1995, Pat. No. 5,647,827.

[51] Int. Cl.[6] ..... A63B 21/02

[52] U.S. Cl. ..... 482/124; 482/121

[58] Field of Search ..... 482/121, 122, 482/124, 125

[56] References Cited

U.S. PATENT DOCUMENTS

| | | | |
|---|---|---|---|
| 2,097,376 | 10/1937 | Marshman | 482/124 |
| 3,162,442 | 12/1964 | Karlik | 482/124 |
| 4,685,671 | 8/1987 | Hagerman et al. | 482/124 |
| 5,135,217 | 8/1992 | Swain | 482/124 |
| 5,306,222 | 4/1994 | Wilkinson | 482/124 |
| 5,362,295 | 11/1994 | Nurge | 482/124 |

*Primary Examiner*—Lynne A. Reichard
*Attorney, Agent, or Firm*—Ezra Sutton

[57] ABSTRACT

An exercise device, including a belt assembly to be worn around the torso of the user having first and second layers formed of nylon or polypropylene. The belt assembly further includes a plurality of attachment rings connected to the belt assembly and hook and loop fastening strips for removably attaching the belt assembly to the torso of the user. The device further includes a pair of hand assemblies each including finger holes for receiving the fingers of the user, a hand strap for removably attaching each hand assembly to a hand of the user, and an elastic hand resistance member having attachment clips thereon for detachably connecting the hand assembly to one of the attachment rings on the belt assembly. In addition, there are a pair of anklet assemblies each including an ankle wrap for removably attaching each anklet assembly to an ankle of the user, a foot strap for removably attaching each anklet assembly to a foot of the user, a heel strap for extending around the bottom of heel of the user and an elastic foot resistance member having attachment clips thereon for detachably connecting the anklet assembly to one of the attachment clips on the belt assembly.

14 Claims, 9 Drawing Sheets

AEROBIC EXERCISE DEVICE

This application is a continuation of U.S. patent application Ser. No. 08/567,531 filed Dec. 5, 1995 now U.S. Pat. No. 5,647,827.

FIELD OF THE INVENTION

This invention relates to a new and improved type of aerobic exercise device, and more particularly, this invention is used to improve the cardiovascular fitness and muscle tone definition of the user, and also provides for a reduction of excess fat in the user's body. The aerobic exercise device is configured such that the user wears an anatomically correct support belt that is detachably connected to harness, hand, and/or foot assemblies which can be used simultaneously while performing walking, running, or stationary exercises.

BACKGROUND OF THE INVENTION

Our personal health is a paramount factor in our day to day living and our personal fitness and exercise is a primary factor in our daily lives. The medical profession has recommended that exercise be part of one's proper daily living routine for a longer, more productive, healthier life. The use of exercise equipment for physical fitness comes in many forms, from jump ropes to expensive Nautilus apparatus.

Personal exercise equipment, exercise devices, or exercise apparatus which include stretchable or resistant-type elastic cords, coils, springs, hydraulic pistons can be used for exercising in the field of physical fitness; physical training for a given sport, such as football, weight lifting, tennis, or basketball, etc.; aerobic conditioning; and/or body building. The devices range from the simplistic, such as hand tension springs or exercise sticks, to complicated Nautilus apparatus and Soloflex devices.

Many forms of exercise devices have been developed in an attempt to provide simple and effective devices using stretchable elastic straps or cords for personal exercise. Some of these devices come in the form of specialized vests, body suits, or belts which are attached to the user's upper body torso or waist, and typically are equipped with elastic straps or cords, with one end of each strap attached to the vest, suit, or belt, and the other end engageable with the user's hands and/or legs.

There remains a need for a portable, aerobic exercise device that is simple and effective, easily assembled, and easily fitted on and operated by a user, and which will eliminate typical joint, ligament and muscle stress injuries when using this type of stretchable elastic exercise device. In addition, there is a further need for an aerobic exercise device that is anatomically correct and which can be used by men and women of all ages to improve their physical fitness in a reduced time frame while still receiving the benefit of a substantial improvement to the user's cardiovascular system and muscle toning without causing any injury, muscle damage, or pain to the user.

DESCRIPTION OF THE PRIOR ART

Exercise devices to be worn by a person having various designs, appearances, materials of construction and functions have been disclosed in the prior art. For example, U.S. Pat. No. 5,372,565 discloses a universal personal exercising device having a belt with hand and leg elastic resistance components, as well as a headband with an elastic resistance component. This device as described and shown is awkward to use as the hand, foot and head straps interfere with the user's normal movement. For example, the foot straps that wrap around and under the arch of the foot would change the user's running gait and possibly injure the arch of the foot when walking or running. The hand straps would become uncomfortable as the elastic loop, during normal movements of the hand, would tighten around the hand unnecessarily and cause pinching and constriction of blood circulation to the hand. The headband attachment using the elastic strap would cause subluxation to the neck area which would cause injury and pain to the user, as this attachment would put unnecessary pressure on the neck and head areas.

U.S. Pat. No. 5,137,272 discloses a personal exercise device having a back foundation plate (belt) with an extension pole, and hand and leg elastic resistance components. This device as described and shown is also awkward to use as the corset-like belt is restrictive to the user and would make exercise of the upper body nearly impossible. The extension pole has the potential to cause injury by snagging on an object as the user is exercising or by tripping the user. The ankle collars are not practical as they would chaff and scrape the ankle area, as the user exercises using the leg elastic straps. In addition, the back plate belt would not fit properly on all users. If someone with a larger build were wearing the back support plate, the metal rim on the support plate would jam into the back and spine areas causing pain and possible injury.

U.S. Pat. No. 5,433,688 discloses a personal exercise device having a belt with elastic resistance hand grips and/or wrist cuffs attached to the front section of the belt. This device is for exercising the upper body only, as it only uses the exerciser's arm movements and would only have minimal health benefits for the user. Any side movement by the user's arms would cause the belt to slide around the torso and the hand grips could slip out of the user's hands and snap-back on the user and possibly cause bodily injury.

Therefore, these prior art exercise devices do not show an exercise device that allows for natural body movements without restrictive or dangerous attachments and which allows for the attaching of elastic resistance cords to the ankles and the hands of the user for freedom of movement without discomfort, pain, or injury.

Accordingly, it is an object of the present invention to provide an aerobic exercise device that is anatomically correct and which prevents user injury to joints, muscles, and ligaments while using the device; and allows for a more effective exercise routine which burns-off more calories (fat) faster than prior low impact exercise devices.

Another object of the present invention is to provide an aerobic exercise device that improves cardiovascular fitness, fat reduction and muscle toning at a faster rate of time through a controlled rate of use while the user is walking, running, doing stationary aerobic exercises, or just worn during a game of golf, touch football, or around the house.

Another object of the present invention is to provide an aerobic exercise device that can be graduated into a more resistant mode of exercise by adding more extension rubber cords to the hand and/or foot assemblies which would drastically cut the time for the user to bring the heart rate into the ideal calorie (fat) burning range.

Another object of the present invention is to provide an aerobic exercise device that would not restrict movements of the user since the elastic resistance components are attached to the upper section of the ankle-wrap covering which would be above the ankle and to the side and rear, and thereby not limit the users range of leg movements. This would also apply to the use of hand pads with securing straps wrapped around the users's hand which would give the user an extensive range of hand movements.

Another object of the present invention is to provide an aerobic exercise device that can be used in conjunction with other fitness training methods, such as aerobic exercise classes, shadow boxing, karate exercises, step aerobics, dancing exercises, jogging, arm wrestling, fencing, and the like.

Another object of the present invention is to provide an aerobic exercise device that can be used in conjunction with other fitness training devices, such as a treadmill, stationary bicycle, body bag, jump rope, punching bag, Nordic Track, Soloflex, or Nautilus apparatus.

Another object of the present invention is to provide an aerobic exercise device that is entirely portable, easily folded and packed away, stored anywhere and used at anytime and anywhere.

A still further object of the present invention is to provide an aerobic exercise device that can be massed produced in an automated and economical manner and is readily affordable by the user.

SUMMARY OF THE INVENTION

In accordance with the present invention, there is provided an exercise device, including a belt assembly to be worn around the torso of the user having a plurality of layers wherein a first layer is formed of rigid plastic and a second layer is formed of a cushioning material. The belt assembly further includes upper and lower back support areas extending from the belt assembly, a plurality of attachment rings connected to the belt assembly and VELCRO™ closure strips for removably attaching the belt assembly to the torso of the user. The device further includes a pair of hand assemblies each including finger holes for receiving the fingers of the user, a hand strap for removably attaching each hand assembly to a hand of the user, and an elastic hand resistance member having attachment clips thereon for detachably connecting the hand assembly to one of the attachment rings on the belt assembly. In addition, there are a pair of anklet assemblies each including an ankle wrap for removably attaching each anklet assembly to an ankle of the user, a foot strap for removably attaching each anklet assembly to a foot of the user, a heel strap for extending around the bottom of heel of the user and an elastic foot resistance member having attachment clips thereon for detachably connecting the anklet assembly to one of the attachment clips on the belt assembly.

BRIEF DESCRIPTION OF THE DRAWINGS

Further objects, features, and advantages of the present invention will become apparent upon consideration of the detailed description of the presently-preferred embodiments, when taken in conjunction with the accompanying drawings wherein.

DETAILED DESCRIPTION OF THE PREFERRED EMBODIMENT

OVERVIEW

Figure 1:
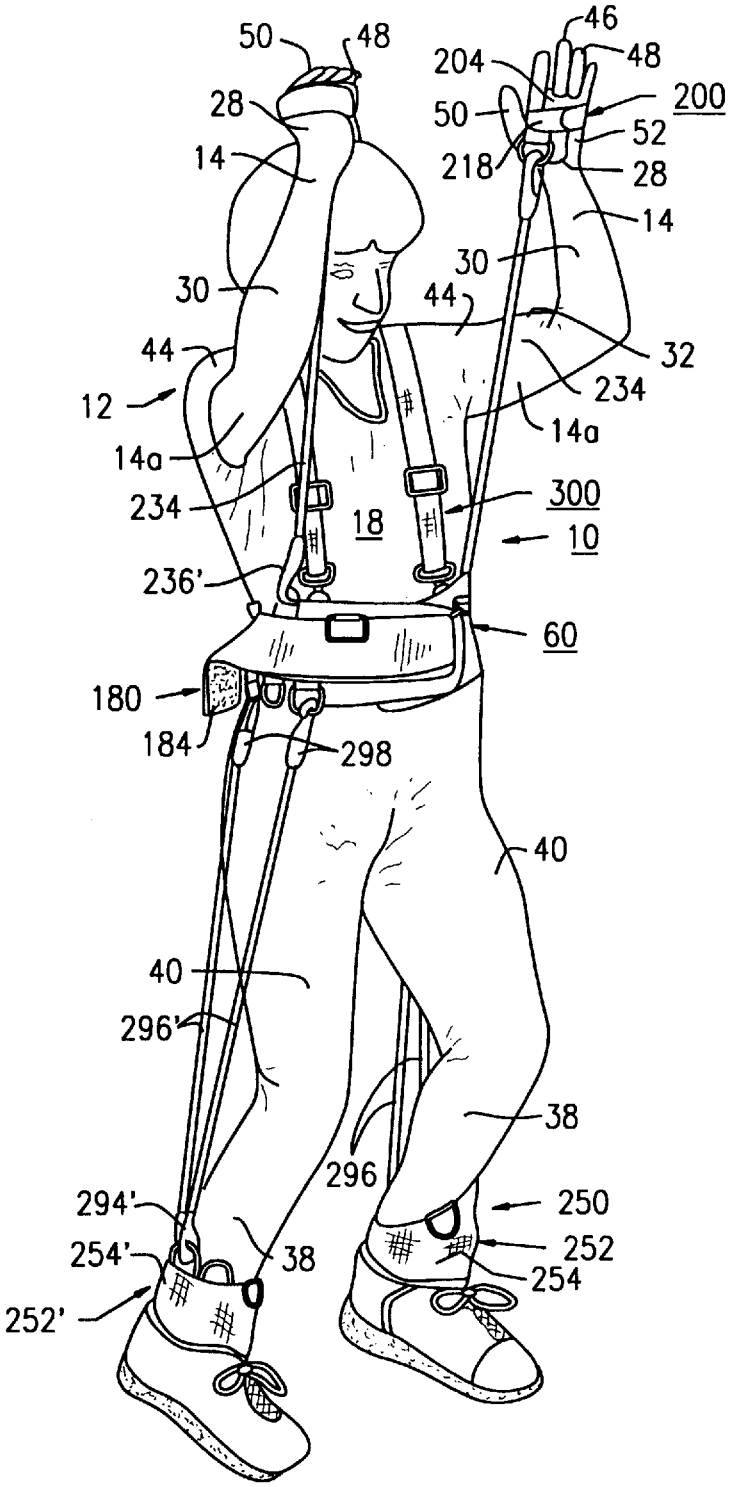
FIG. 1 is a perspective view of the aerobic exercise device of the present invention showing a user exercising outdoors while wearing the belt assembly with the hand, foot, and harness assemblies attached.
Figure 2:
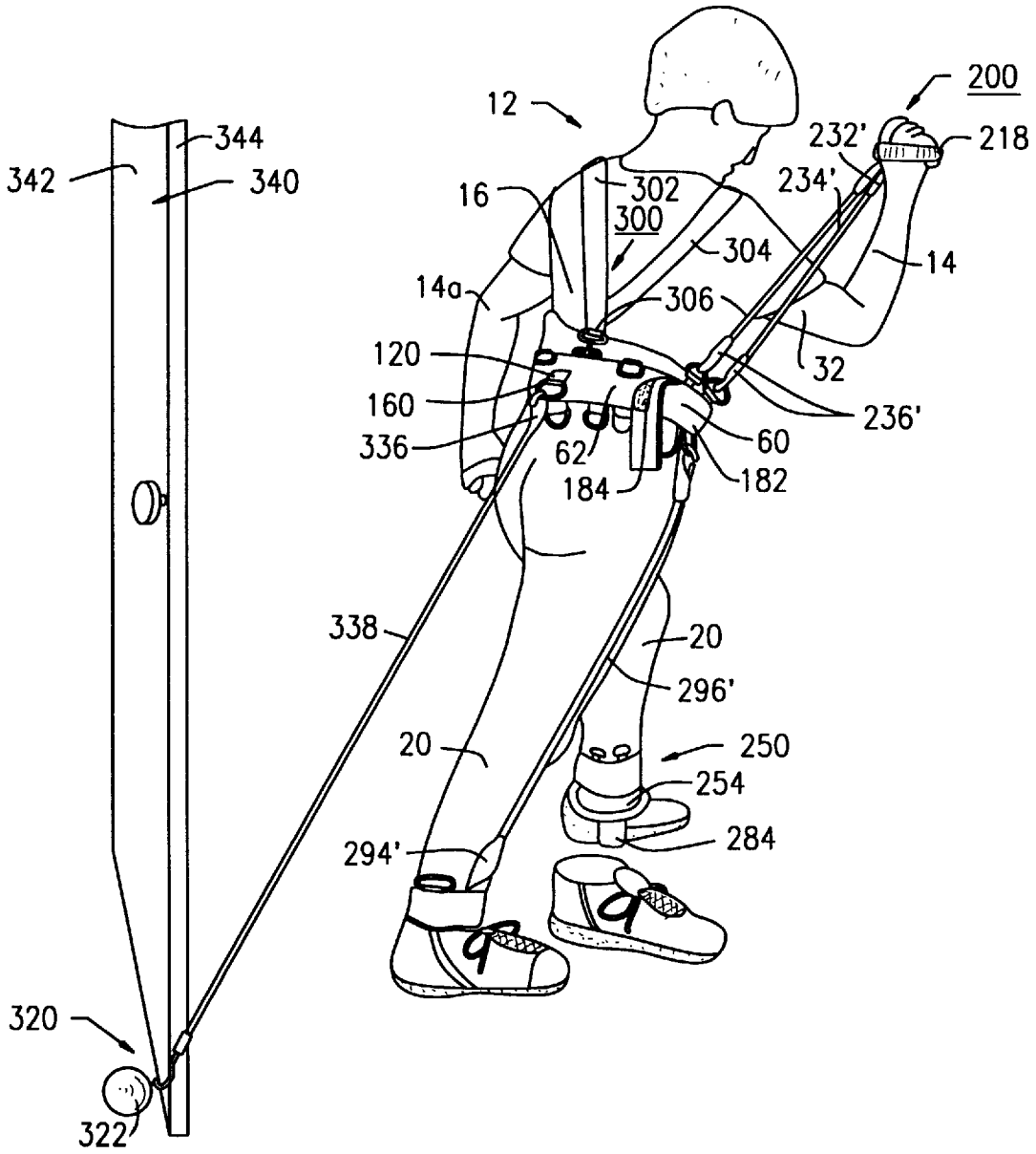
FIG. 2 is a rear perspective view of the aerobic exercise device showing a user exercising indoors in a room while wearing the belt assembly with the hand, foot, harness, and ball assemblies attached.

The preferred embodiment of the present invention provides an aerobic exercise device 10, used for exercising various parts of the user's body 12, such as the arms 14, back 16, stomach 18 and legs 20 which also improves the cardiovascular system of the user, as represented by FIGS. 1 through 9. FIGS. 1 and 2 show the aerobic exercise device 10 in an operational mode. FIGS. 3 through 9 show the aerobic exercise device 10 and its various assemblies. The aerobic exercise device 10 includes a belt assembly 60 for providing back and upper body support to the lower lumbar and sacro-iliac regions 22 and 24, as well as, the oblique muscle groups 26 of the back area 16 of the user's body 12. Belt assembly 60 is the focal point of the aerobic exercise device 10, which includes the hand assembly 200, the foot assembly 250, and the harness assembly 300 each of which may be detachably connected to the belt assembly 60 for the exercising of the arms 14, stomach 18, and legs 20. The hand assembly 200 includes left and right hand components 202 and 202' which specifically exercise the user's wrists 28, forearms 30, and biceps/triceps areas 32 and 34. The foot assembly 250 includes left and right anklet components 252 and 252' which specifically exercise the user's ankles 36, calves 38, and thighs 40. The harness assembly 300 includes a shoulder support 44 for the user which lessens the tension put on the belt panel 62 by using the shoulder areas 44 for support, and this is done in conjunction with the use of the belt assembly 60 and the harness assembly 300. The ball attachment assembly 320 is an adjunct accessory for the aerobic exercise device 10 if the user wants to exercise indoors and it is only necessary to attach the ball component 322 to a door frame.

BELT ASSEMBLY 60

Figure 3:
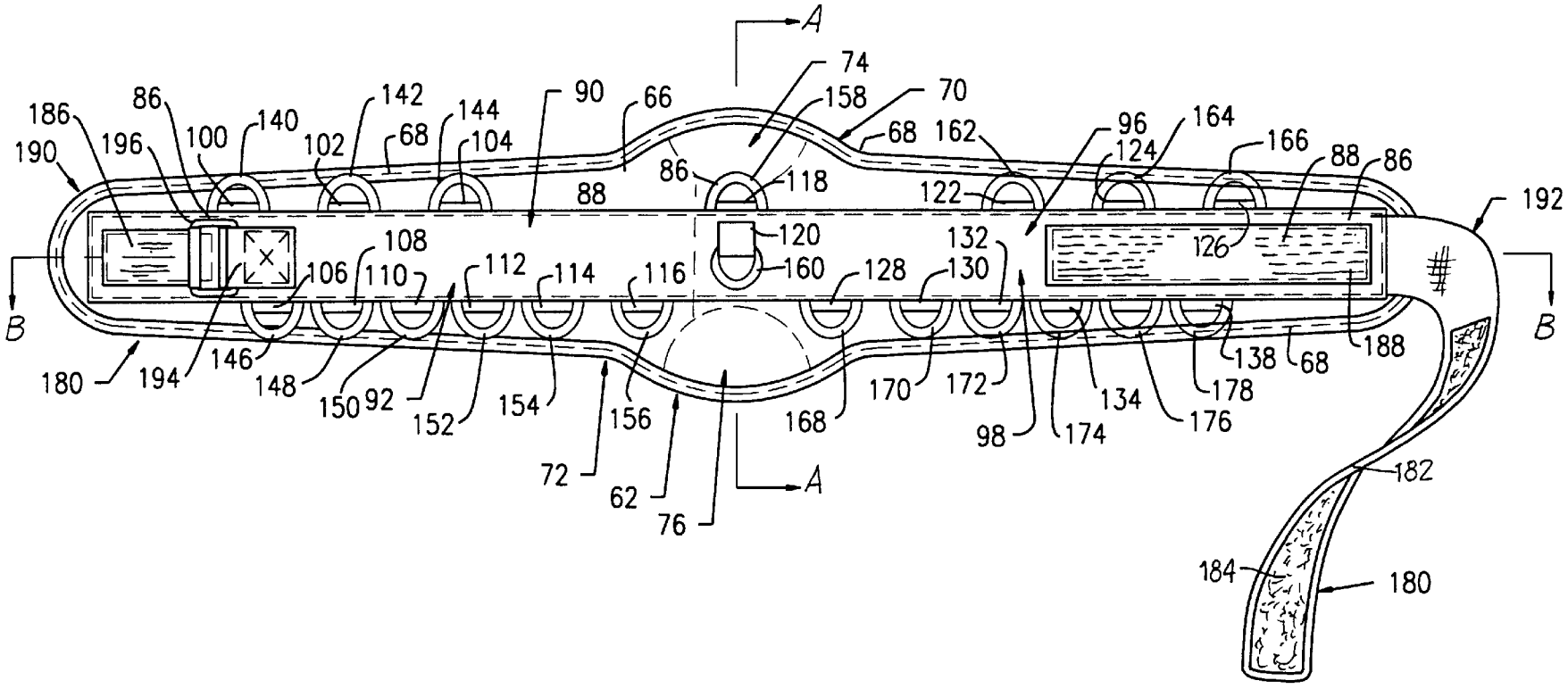
FIG. 3 is a rear perspective view of the belt assembly of the aerobic exercise device showing the exterior surface having various component parts contained thereon.
Figure 4:
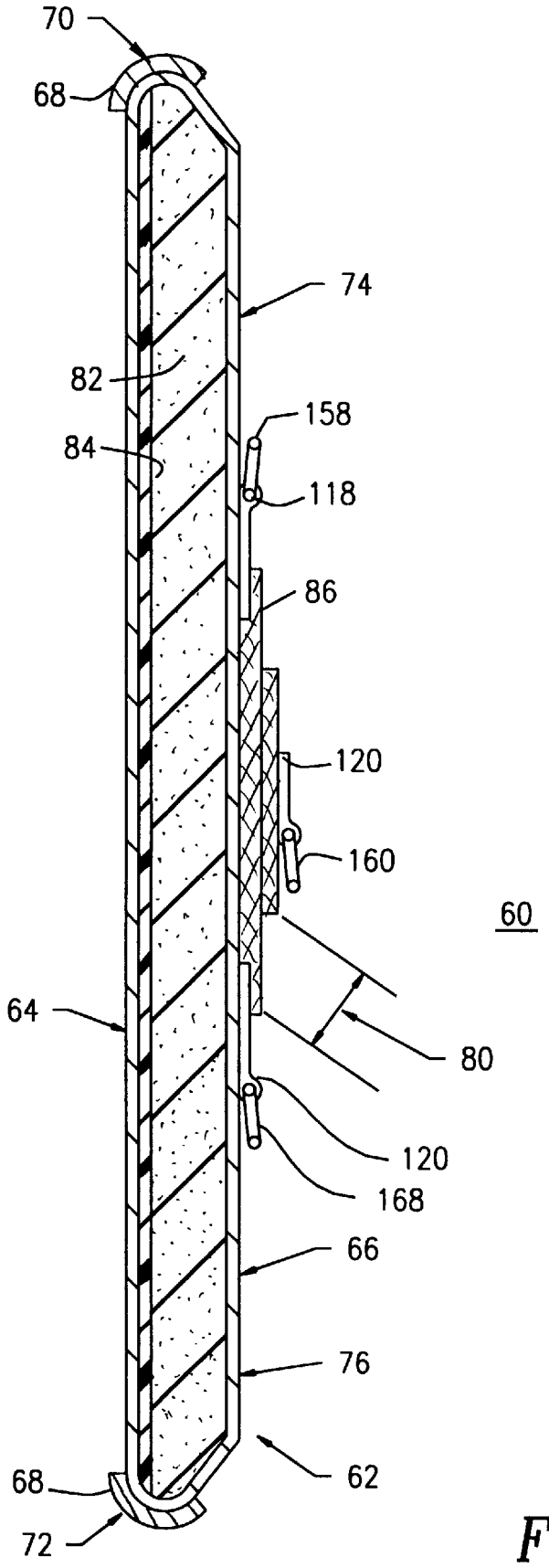
FIG. 4 is a cross-sectional view of the belt assembly showing the various layer components contained therein.

As shown in FIGS. 1, 2, 3, and 4, belt assembly 60 includes a tapered belt panel 62 having Cordura™ nylon interior and exterior surface walls 64 and 66 connectedly sewn together to a strip of cloth 68 to form an outer upper and lower perimeter edging 70 and 72. Surface walls 64 and 66 can also be made from dacron, cotton, cotton/polyester blends, and the like. Semi-oval upper and lower back support areas 74 and 76 extend from belt panel 62 for giving back support to the lumbar and sacro-iliac regions 22 and 24 of the user's body 12. Belt assembly 60 has a multi-layered construction 80, as shown by cross-section A—A of FIG. 3, such that there is a nylon interior wall 64; an inner foam layer 82 for cushioning the back area 16 of the user's body 12; an inner plastic wall 84 for belt panel 62 rigidity and back support; a nylon exterior wall 66; an exterior nylon webbing 86 for attachment of ring moorings; and closure means 180 for closing the belt panel 62 around the user's waist 42. The inner plastic wall 84 is approximately 22 mils thick and is adjacent to exterior wall 66 with the foam layer 82 being approximately a half inch thick (½") and is integrally attached to the inner plastic wall 84, as depicted in FIG. 4.

Exterior nylon webbing 86 is centrally located along axis line B—B, as shown in FIG. 3, and is fixedly connected by nylon thread 88 to the exterior wall 66. Nylon webbing 86 includes a plurality of strap loops 100, 102, 104, 106, 108, 110, 112, 114, 116, 118, 120, 122, 124, 126, 128, 130, 132, 134, 136, and 138 having attachment rings 140, 142, 144, 146, 148, 150, 152, 154, 156, 158, 160, 162, 164, 166, 168, 170, 172, 174, 176, and 178 integrally attached to webbing 86 and located in the upper and lower left side webbing quadrant areas 90 and 92, in the center webbing area 94 and in the upper and lower right side webbing quadrant areas 96 and 98. Specifically, attachment rings 140 to 144 are positioned in the upper left side webbing quadrant area 90; attachment rings 146 to 156 are positioned in the lower left side webbing quadrant area 92; attachment rings 158 and 160 are positioned in the center webbing area 94; attachment rings 162 to 166 are positioned in the upper right side webbing quadrant area 96; and attachment rings 168 to 178 are positioned in the lower right side webbing quadrant area 98, as depicted by FIG. 3 of the drawings. The attachment rings may be made of any suitable material, such as metal, plastic or nylon.

Belt panel 62 has an overall length of thirty-two inches (32") to forty-eight inches (48") depending upon the waist 42 measurement of the user, with the preferred belt panel 62 length being approximately forty inches (40"). The belt panel 62 width measurement is eight inches (8") wide at the back support areas 74 and 76 and it gradually tapers down to a four inch (4") width at each belt panel end 190 and 192. Each strap loop 100 to 138 has a width measurement of 1 inch having a ¼inch diameter opening, and metal attachment rings 140 to 178 have an oval opening measurement of 1¼ inches by ¾ inches. Nylon webbing 86 measures three inches (3") in width by thirty-eight inches (38") in length for the preferred embodiment. Belt panel 62 may be made in small, medium, large and extra-large sizes for both women and men having a variety of waist sizes.

Closure means 180 include a belt strap section 182 having an integrally attached VELCRO™ loop section 184 thereon; a pair of VELCRO™ left and right side hook sections 186 and 188 integrally attached to nylon webbing 86 at the left and right side panel ends 190 and 192, and a belt strap loop 194 having a belt strap attachment ring 196 integrally attached to nylon webbing 86 at panel end 190, as shown in FIG. 3 of the drawings. Belt strap attachment ring 196 is used in conjunction with belt strap 182 for securing the belt panel 62 around the user's waist 42. Belt strap 182 measures two inches (2") in width by twenty-two inches (22") in length having a thickness of approximately one-eighth of an inch (⅛").

HAND ASSEMBLY 200

Figure 5:
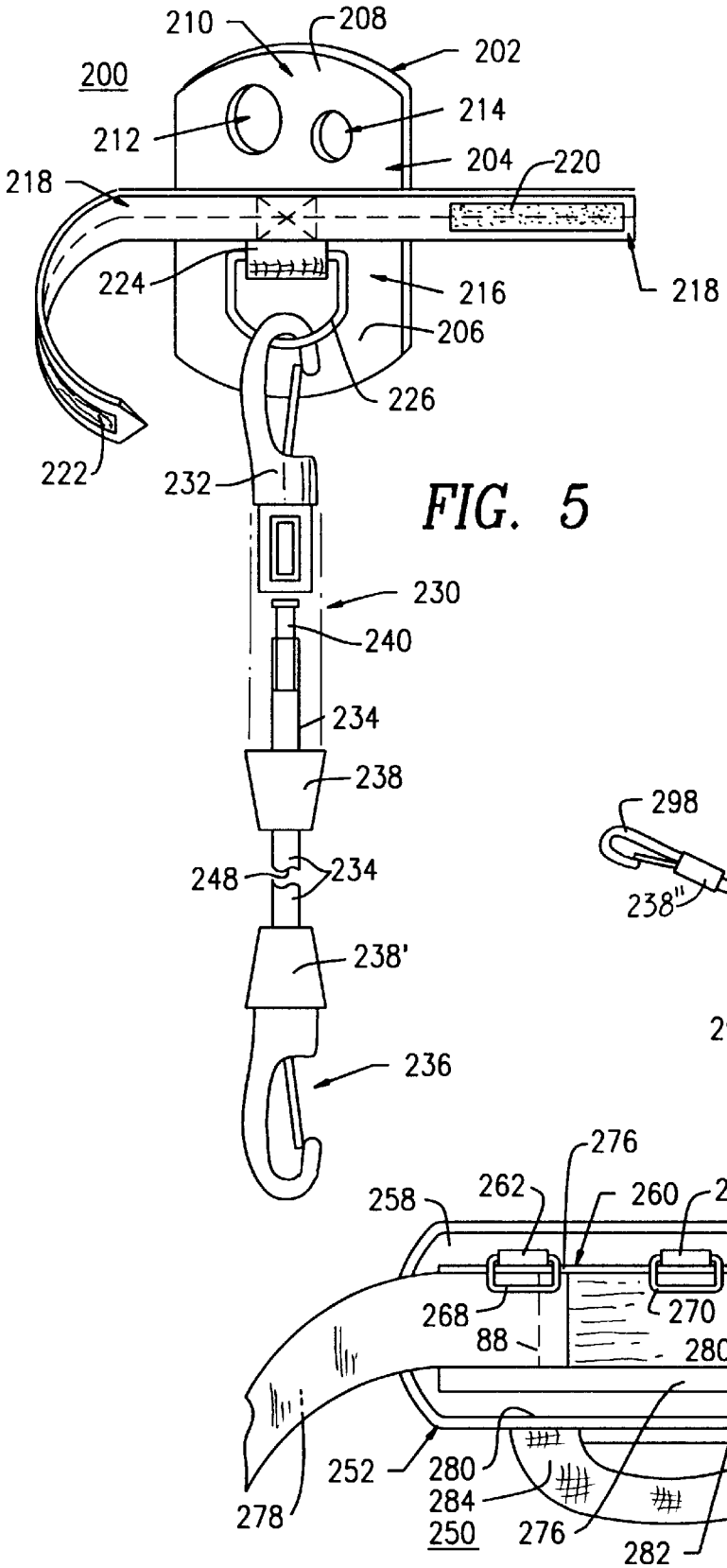
FIG. 5 is a rear perspective view of the hand assembly of the aerobic exercise device showing the exterior surface having various component parts contained thereon.

Hand assembly 200, as shown in FIG. 5, consists of left and right hand components 202 and 202' each of which includes a hand pad 204 made of nylon, leather, rubber, vinyl, plasticized rubber, or Naugahyde™, and the like materials having interior and exterior surfaces 206 and 208. Hand pad 204 has an upper section 210 having hole openings 212 and 214 for receiving the middle and ring fingers 46 and 48 of the user's hand 50, with the palm area 52 of the user's hand 50 being in contact with the interior surface 206 of the lower section 216 of hand pad 204. Hand component 202 further includes a hand strap 218 with integrally attached VELCRO™ loop and hook longitudinal tabs 220 and 222; and a hand strap loop component 224 with an attachment ring 226.

Hand pad 204 measures two inches (2") in width by four inches (4") in height having a material thickness of approximately one-sixteenth of an inch (1/16"). Hand strap 218 secures the hand pad 204 around the user's hand 50. Hand strap 218 measures one inch (1") in width by twelve inches (12") in length having a material thickness of approximately one-sixteenth of an inch (1/16").

Hand assembly 200 also includes a flexible and stretchable hand extension member 230 having detachable hand and belt attachment clips 232 and 236 that are integrally attached to a hollow rubber cord or bungee cord 234. Rubber cord 234 measures nine inches (9") in length and has a three-eights of an inch (⅜") diameter. As shown in FIG. 5, hand attachment clip 232 includes an attachment collar 238, a reinforcing insert component 240, and an internal retaining collar 242 having a hole opening 244. The internal retaining collar 242 is integrally connected to the attachment clip 232 and is for receiving the end section 246 of rubber cord 234 and the reinforcing insert component 240. Insert component 240 is inserted within rubber cord end opening 248, such that when attachment collar 238 is snapped around the internal retaining collar 242, the rubber cord 234 is immobilized and cannot be pulled away from the attachment clip 232. All of the attachment clips used in this aerobic exercise device all have the same aforementioned component parts contained therein.

The right-hand component 202' is a mirror image of the left-hand component 202 previously discussed and includes all of the same component parts as the left-hand component 202, as shown in FIGS. 1, 2, and 5 of the drawings.

FOOT ASSEMBLY 250

Figure 6:
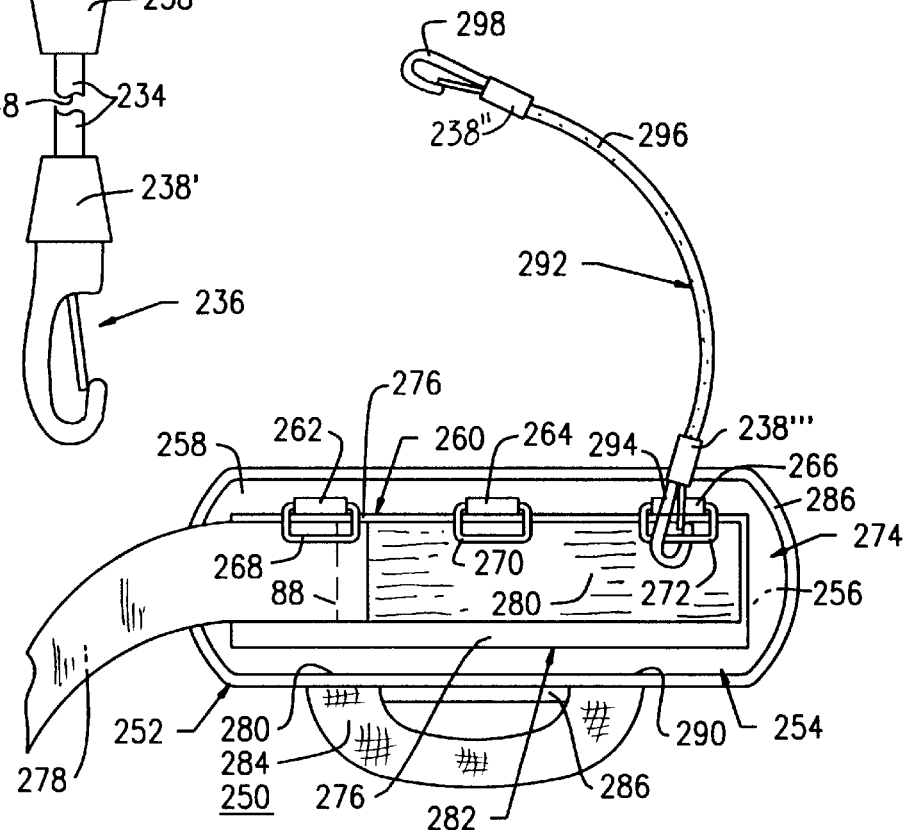
FIG. 6 is a rear perspective view of the foot assembly of the aerobic exercise device showing the exterior surface having various component parts contained thereon.
Figure 7:
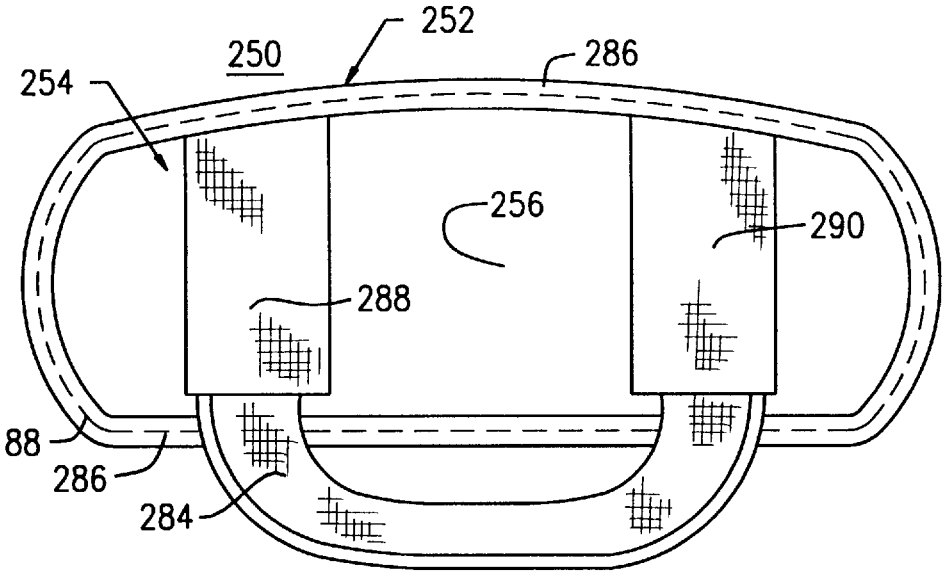
FIG. 7 is a front perspective view of the foot assembly of the aerobic exercise device showing the interior surface having various component parts contained thereon.

Foot assembly 250, as shown in FIGS. 6 and 7, consists of a left and right anklet components 252 and 252' each of which includes an ankle-wrap covering 254 made of nylon having interior and exterior surfaces 256 and 258. Ankle-wrap covering 254 has an upper section 260 having a plurality of equally spaced foot strap loops 262, 264, and 264 with respective attachment rings 268, 270, and 272 being integrally attached to the exterior surface 258 of ankle-wrap covering 254. Ankle-wrap covering 254 further includes a center section 274 having a longitudinal, rectangular webbing strip component 276 integrally attached to the exterior surface 258 of ankle wrap covering 254. Webbing strip 276 includes VELCRO™ loop and hook rectangular fastening strips 278 and 280 for securing the anklet component 252 around the ankle area 36 of the user's foot 54. Ankle-wrap covering 254 also includes a lower section having a heel strap 284 integrally attached to the interior surface 256 along perimeter edging 286 and by attachment to webbing components 288 and 290.

Ankle wrap covering 254 measures five and one-quarter inches (5¼") in width by fourteen inches (14") in length having a material thickness of approximately one-eighth of an inch (⅛"). External webbing strip 276 measures three inches (3") in width by twelve inches (12") in length having a material thickness of approximately one-sixteenth of an inch (1/16"). Interior webbing components 288 and 290 measure three inches (3") in width by four and three-quarters inches (4¾") in height having a material thickness of approximately one-sixteenth of an inch (1/16 "). Heel strap 284 measures two inches (2") in width by ten inches (10") in lineal length having a material thickness of one-sixteenth of an inch (1/16"). VELCRO™ fastening strips 278 and 280 measure two inches (2") in width by eight inches (8") in length, as shown in FIG. 7 of the drawings.

Foot assembly 250 also includes flexible and stretchable foot extension members 292 having detachable foot and belt attachment clips 294 and 298 that are integrally attached to a hollow rubber cord 296 or a bungee cord 296, as depicted in FIG. 6. Rubber cord 296 measures eleven inches (11") in length and has a three-eights of an inch (⅜") diameter. The right anklet component 252' is a mirror image of the left anklet component 252 and includes all of the same parts.

HARNESS ASSEMBLY 300

Figure 8:
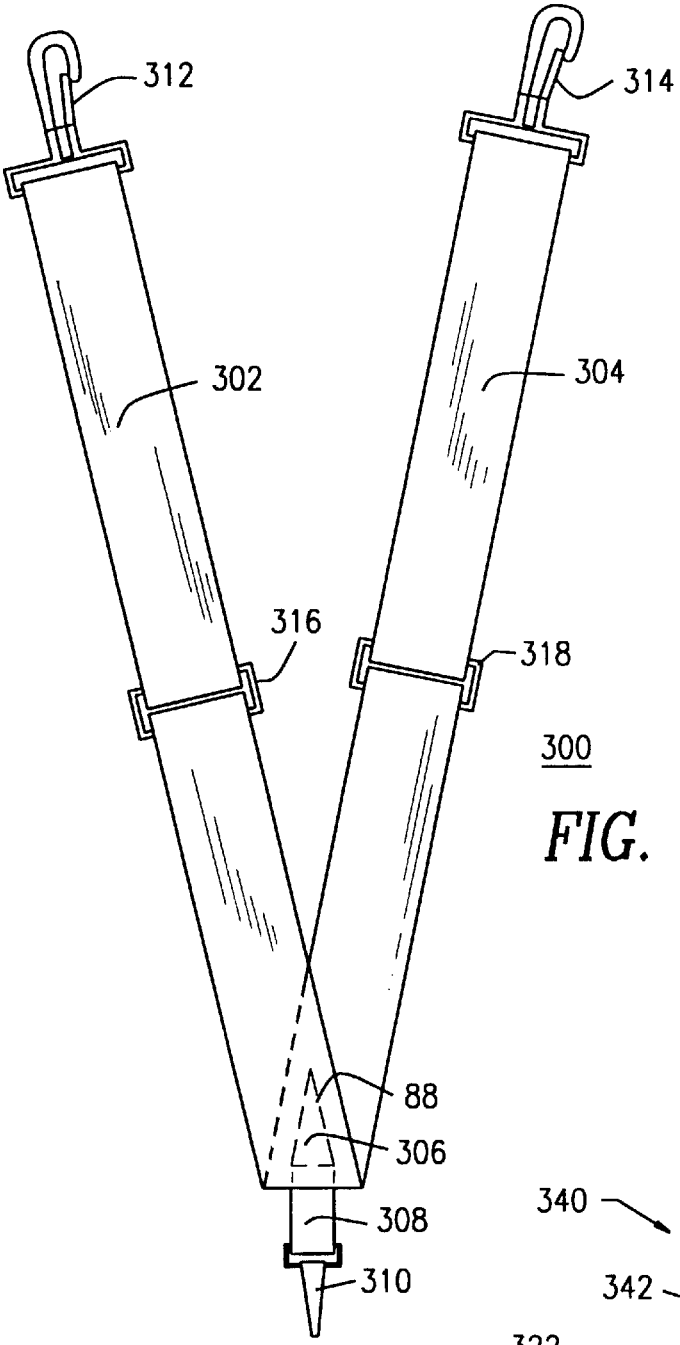
FIG. 8 is a front view of the harness assembly of the aerobic exercise device showing the harness support straps, the attachment clips and the adjustment buckles.

Harness assembly 300, as shown in FIG. 8, for providing shoulder support is V-shaped and includes a pair of adjustment straps 302 and 304 integrally attached at one end 306 by heavy duty stitching 88 and also includes a strap loop 308 with a back attachment clip 310 for attaching to the back area 94 of belt panel 62 using attachment ring 158. Each adjustment strap 302 and 304 further includes front attachment clips 312 and 314 having adjustment buckles 316 and 318 for adjusting the harness assembly 300 to a proper length and fit for the user. Attachment clips 312 and 314 are used for attaching to the front area of belt panel 62 using attachment rings 100 or 102 and 124 or 126. The harness straps 302 and 304 are made from a heavy duty nylon material and each strap 302 and 304 is 2 inches (2") wide by 37 inches (37") long in their extended positions.

BALL ATTACHMENT ASSEMBLY 320

Figure 9:
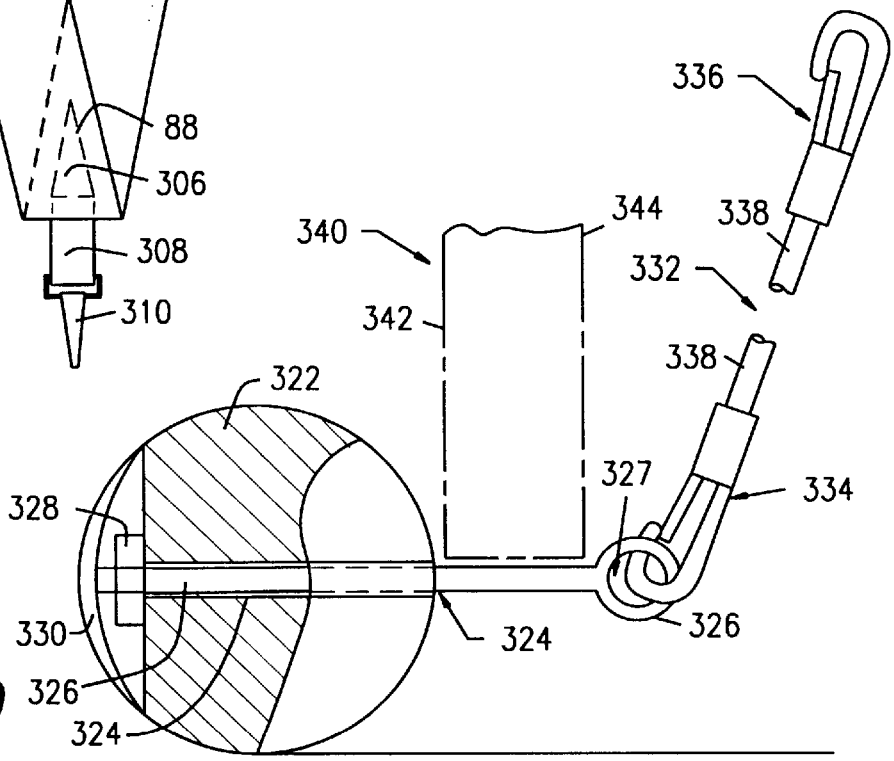
FIG. 9 is front view of the ball attachment assembly of the aerobic exercise device showing the ball component, the eyelet bolt, the cap, and the extension means.

Ball attachment assembly 320, as shown in FIG. 9, is used as an anchor accessory, when the aerobic exercise device 10 is to be used indoors due to inclement weather or the necessity of being indoors. Ball attachment assembly 320 is used in conjunction with a closed door, closed window frame, or a heavy piece of furniture. Ball attachment assembly 320 includes a rubber or plastic ball component 322 having a centrally located core opening 324 for an eyelet bolt 326 with an eyelet opening 327 and fastening nut 328. Ball component 322 also includes a snap on or screw on cap 330 for completion of its spherical shape.

Ball attachment assembly 320 also includes a single flexible and stretchable ball extension member 332 having detachable ball and belt attachment clips 334 and 336 that are integrally attached to an elongated hollow rubber elastic cord 338 or a bungee cord 338. Ball attachment clip 334 attaches to eyelet opening 327 of eyebolt 326 and attachment clip 336 attaches to the back area 94 of belt panel 62 using attachment ring 160, as depicted in FIG. 2 of the drawings. The physical measurements for the ball attachment assembly 320 are as follows: ball component 322 has a 3½ inch diameter, eyebolt 326 is 4 inches long and extension cord 338 measures in the range 30 to 42 inches in length.

DETAILED DESCRIPTION OF THE SECOND EMBODIMENT OF BELT ASSEMBLY 460

Figure 10:
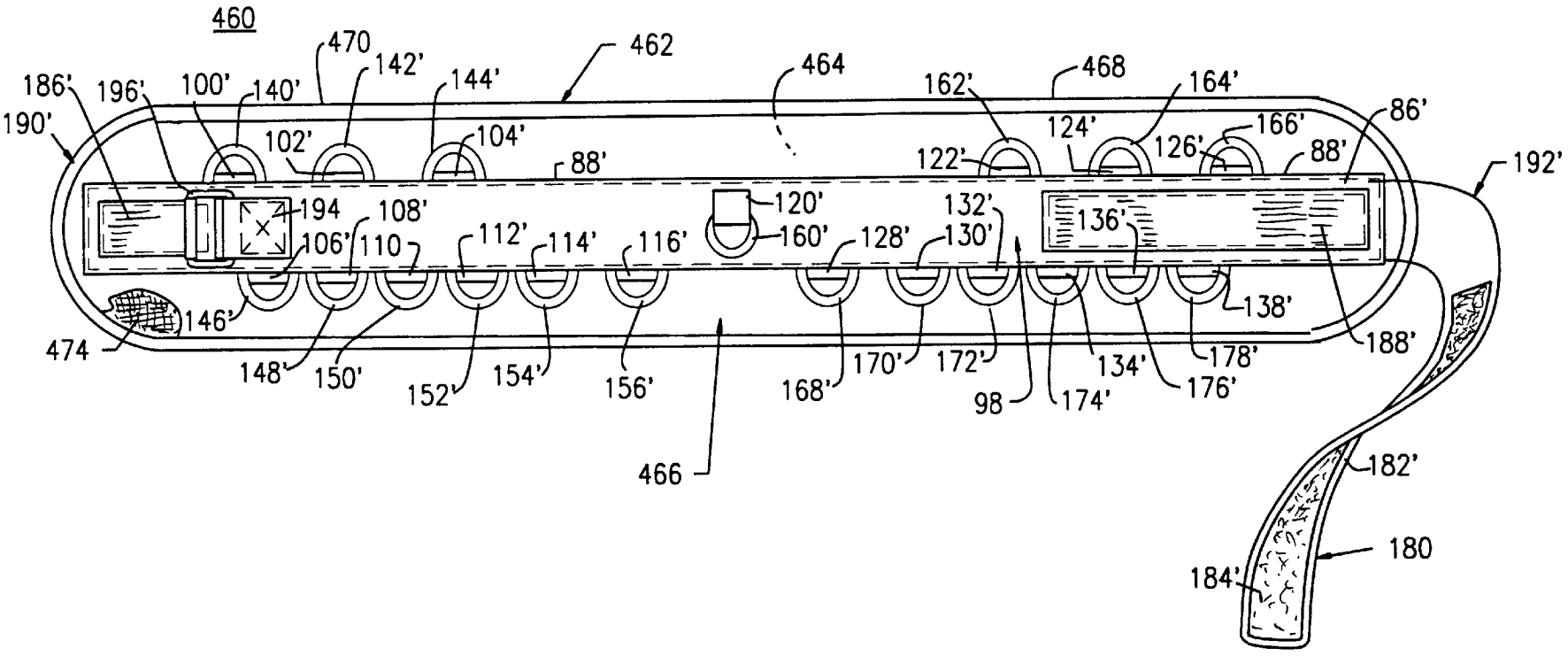
FIG. 10 is a rear perspective view of the belt assembly of the second embodiment of the aerobic exercise device showing the exterior surface having various component parts contained thereon.

An alternate embodiment 400 of the aerobic exercise device 10 of the present invention is depicted in FIG. 10 of the drawings. All aspects of the alternate embodiment of the aerobic exercise device 400 are the same as the preferred embodiment of exercise device 10, except for the shape and size of belt panel 462 of belt assembly 460. Aerobic exercise belt assembly 460 lends itself for use mainly by females because of its light weight size and its shape.

As shown in FIG. 10, belt panel 462 of belt assembly 460 is rectangular in shape having interior and exterior surface walls 464 and 466 made of Cordura™ nylon and are sewn together to a strip of cloth 468 to form upper and lower perimeter edging 470 and 472. belt panel 462 contains only a rigid foam layer 474 for cushioning the back area 16 of the user's body 12. Foam layer 474 is approximately one-quarter of an inch (¼") thick. Belt panel 462 measures six inches (6") in width by thirty-five inches (35") in length with an approximate thickness of three-eights of an inch (⅜"). All other component parts of belt assembly 460 are the same as the preferred embodiment of belt assembly 60 and are designated by a "prime" symbol to indicate this.

DETAILED DESCRIPTION OF THE THIRD EMBODIMENT OF BELT ASSEMBLY 560

Figure 11:
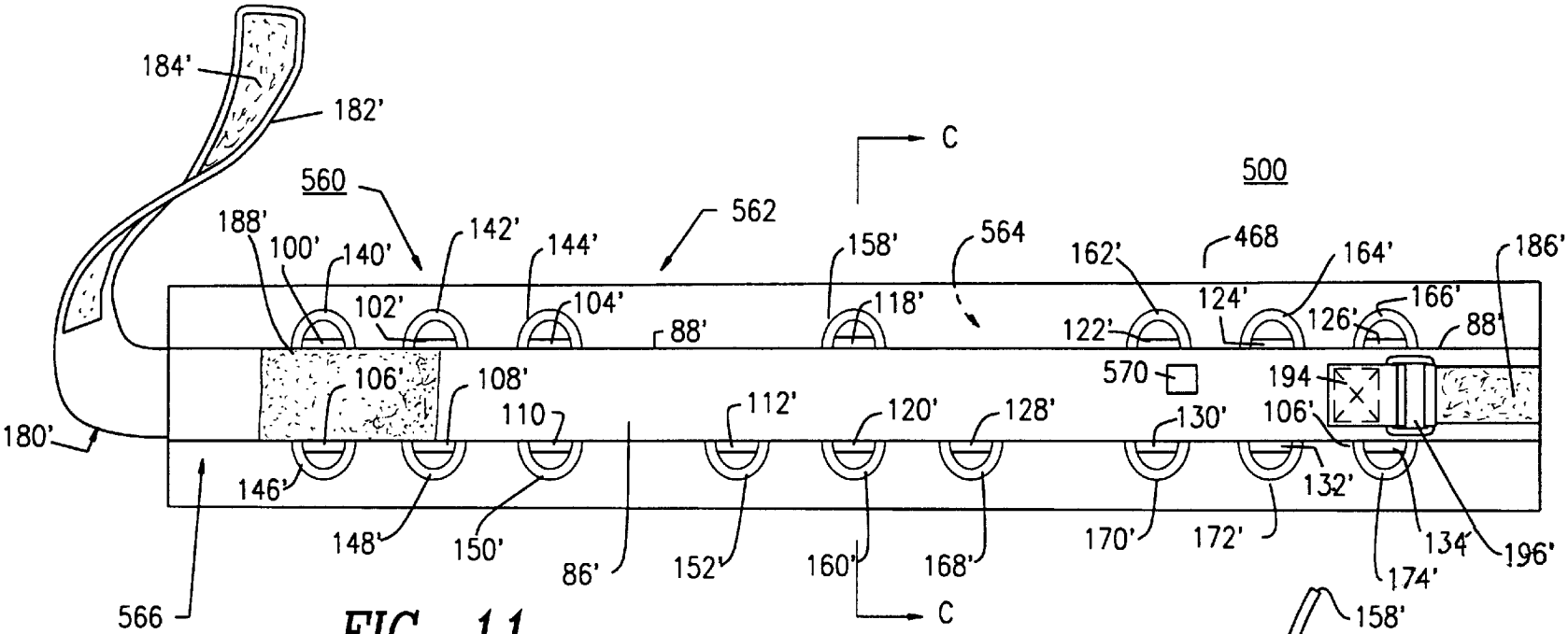
FIG. 11 is a rear perspective view of the belt assembly of the third embodiment of the aerobic exercise device showing the exterior surface having various component parts contained thereon.
Figure 12:
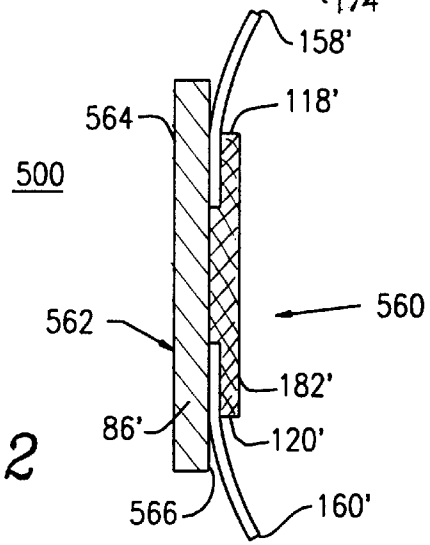
FIG. 12 is a cross-sectional view of the belt assembly of the third embodiment of the aerobic exercise device taken along lines C—C of FIG. 11 showing the various layer components contained therein.

An alternate third embodiment 500 of the aerobic exercise device 10 of the present invention is depicted in FIGS. 11 and 12 of the drawings. All aspects of the alternate embodiment of the aerobic exercise device 500 are the same as the preferred embodiment of exercise device 10, except for the shape and size of belt panel 562 of belt assembly 560, and it has no foam layers 82 or 474 for back support, and it has fewer strap loops for the lower left side and lower right side webbing quadrant areas 92 and 98, respectively. Aerobic exercise belt assembly 560 lends itself for use mainly as an exercise fitness belt because of its light weight, compact size and its shape.

As shown in FIGS. 11 and 12, belt panel 562 of belt assembly 560 is rectangular in shape having interior and exterior surface walls 564 and 566 made of a black polypropylene or nylon webbing 86'. In addition, belt panel 562 is attached by sewing to a smaller webbing 182'. Webbing 182' includes three VELCRO™ hook and loop fastening strips 184', 186', and 188' being sewn on webbing 182' for adjusting the belt panel 562 on the user. Webbing 182' may also be polypropylene or nylon. Further, there is an additional VELCRO™ hook and loop square fastening patch 570 for use with the hand assembly 200 of the preferred embodiment.

Belt panel 562 measures three inches (3") in width by thirty-two inches (32") in length with an approximate thickness of one-eighth of an inch (⅛"). Webbing 182' measures two inches (2") in width by forty-two (42") in length with an approximate thickness of one-eighth of an inch (⅛"). All other component parts of belt assembly 560 are the same as the preferred embodiment of belt assembly 60 and are designated by a "prime" symbol to indicate this.

Attachment rings 142', 144', 162' and 164' are used in conjunction with the hand assembly 200. Attachment rings 146', 148', 150', 152', 168', 170', 172', and 174' are used in conjunction with the foot assembly 250. When the user changes attachment rings in using the hand assembly 200 and/or foot assembly, the user exercising can change the muscle being exercised and/or the tension applied to those muscles. Attachment rings 140', 158' and 166' are used in conjunction with the harness assembly 300. Attachment ring 160' is used in conjunction with the ball attachment assembly 320.

OPERATION OF THE PRESENT INVENTION

In operation the aerobic exercise device 10 is readily put into operational use whether the user wants to exercise outdoors or indoors. First, the user unpacks, and unfolds the belt assembly 60, where then the user wraps belt panel 62 around the user's waist 42, such that the interior surface wall 64 is in contact with the lower lumbar and sacro-iliac regions 22 and 24 of the user's back 16. The user then secures the belt panel 62 around the waist 42 by fastening and putting the belt strap 182 through strap attachment ring 196 which is then closed by the VELCRO™ hook and loop fastening strips 184 and 186. The belt strap 182 is tightened to the user's convenience and comfort level. The user then unpacks and unfolds the hand, foot, and harness assemblies 200, 250, and 300, respectively. Next, the user, if needed for shoulder support, would strap on the harness assembly 300 to belt panel 62 by attaching the rear harness clip 310 to attachment ring 158 and the front attachment clips 312 and 314 to attachment rings 126 and 100, respectively. The user then adjusts the strap buckles 316 and 318 by tightening or loosening them to his/or her comfort level, as shown in FIGS. 1 and 2.

The user next attaches the anklet components 252 and 252' around the ankles 36 and heels (arches) 56 of the user's feet 54 such that the interior walls 256, and 256' and heel straps 284 and 284' of wrap coverings 254 and 254' are adjacent to the user's ankle areas 36 and heels 56. The user then encloses the feet 54 securely by closing the VELCRO™ hook and loop fastening strips 278 and 280; and 278' and 280' on each other, as shown in FIGS. 1 and 2.

The user now attaches the hand components 202 and 202' around each hand 50 such that the interior walls 206 and 206' of hand pads 204 and 204' are in contact with the palm area 52 of each hand 50, and such that the middle and ring fingers 46 and 48 extend through openings 212 and 214, and 212' and 214'. The user then wraps the hand straps 218 and 218' around the top of each hand 50 and encloses each hand 50 securely by closing the VELCRO™ hook and loop fastening strips 220 and 222 and 220' and 222' on each other, as shown in FIGS. 1 and 2.

The user now connects the left and right foot extension members 292 and 292' to the belt panel 62 by connecting the left belt attachment clip 298 for the left foot 54 to anyone of attachment rings 146 to 156 on the left side of belt panel 62; and by connecting the right belt attachment clip 298' for the right foot 54' to anyone of attachment rings 168 to 178 on the right side of belt panel 62. Each foot extension member 292 and 292' provides for 15 to 25 pounds tension.

Similarly, the user now connects the left and right hand extension members 230 and 230' to the belt panel 62 by connecting the left belt attachment clip 236 for the left hand 50 to anyone of attachment rings 100 to 104 on the left side of belt panel 62; and by connecting the right belt attachment clip 236' for the right hand 50' to anyone of attachment rings 122 to 126 on the right side of belt panel 62. Each hand extension member 230 and 230' provides for 20 to 25 pounds tension.

The user is now ready to perform his or her exercise routine using exercise device 10. During use of the aerobic exercise device 10 the user may be able to move their hands 50 and legs 20 in place, or alternatively, the user may jog or run and is free to move the arms 14 and legs 20 in a normal jogging or running manner without interference by the hand and foot assemblies 200 and 250, respectively. While using the exercise device 10 of the present invention, the user can substantially reduce the time it takes to reach a desired heart rate for efficient exercising and burning of calories. Thus, during proper use the user may accomplish the same exercise results in approximately one-half (½) of the time as compared to a person not using the exercise device 10 of the present invention.

If the user wants to use the aerobic exercise device 10 indoors, the user can attach the ball attachment assembly 300 to the user's belt panel 62. The user attaches belt attachment clip 336 to attachment ring 158 on belt panel 62 and then places ball component 322 behind a door 340 closes the door 340, and slips the elastic cord 338 under the door 340 such that, ball component 322 is adjacent to the outside wall 342 of door 340 and forms an anchor assembly for the exercise device 10. The user is now ready to proceed with stationary exercising, as previously mentioned.

It should be noted that additional hand and foot extension members 230''' and 292''' can be added to belt panel 62 to provide increased tension to the arms 14 and legs 20 while exercising with the aerobic exercise device 10 of the present invention.

ADVANTAGES OF THE PRESENT INVENTION

Accordingly, an advantage of the present invention is that it provides for an aerobic exercise device that is anatomically correct and which prevents user injury to joint, muscles, and ligaments while using the device; and allows for a more effective exercise routine which then burns-off more calories (fat) faster than prior low impact exercise devices.

Another advantage of the present invention is that it provides for an aerobic exercise device that improves cardiovascular fitness, fat reduction, and muscle toning at a faster rate of time through a controlled rate of use while the user is walking, running, or doing stationary aerobic exercises.

Another advantage of the present invention is that it provides for an aerobic exercise device that can be graduated into a more resistant mode of exercise by adding more extension rubber cords to the hand and/or foot assemblies which would drastically cut the time for the user to bring the heart rate into the ideal calorie (fat) burning range.

Another advantage of the present invention is that it provides for an aerobic exercise device that would not restrict movements of the user since the elastic resistance components are attached to the upper section of the ankle-wrap covering which would be above the ankle and to the side and rear, and thereby not limit the users range of leg movements. This would also apply to the use of hand pads with securing straps wrapped around the user's hand which would give the user an extensive range of hand movements.

Another advantage of the present invention is that it provides for an aerobic exercise device that can be used in conjunction with other fitness training methods, such as aerobic exercise classes, shadow boxing, karate exercises, step aerobics, dancing exercises, jogging, arm wrestling, fencing, and many other forms of recreation.

Another advantage of the present invention is that it provides for an aerobic exercise device that can be used in conjunction with other fitness training devices, such as a treadmill, stationary bicycle, body bag, jump rope, punching bag, Nordic Track, Soloflex, or Nautilus™ apparatus.

Another advantage of the present invention is that it provides for an aerobic exercise device that is entirely portable, easily folded and packed away, stored anywhere and used at anytime and anywhere.

A still further advantage of the present invention is that it provides for an aerobic exercise device that can be massed produced in an automated and economical manner and is readily affordable by the user.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. An exercise device, comprising:

a) a belt assembly to be worn around the torso of the user including first and second layers formed of flexible plastic material;

b) said belt assembly further including a plurality of attachment means connected to said belt assembly and closure means for removably attaching said belt assembly to the torso of the user;

c) a pair of hand assemblies each including a hand pad for engaging the palm of the user, said hand pad having finger holes through which the fingers of the user pass, a hand strap for removably attaching each hand assembly to a hand of the user, and an elastic hand resistance member having attachment means thereon for detachably connecting said hand assembly to one of the attachment means on said belt assembly; and d) a pair of anklet assemblies each including an ankle wrap for removably attaching each anklet assembly to an ankle of the user, a foot strap for removably attaching each anklet assembly to a foot of the user, a heel strap for extending around the bottom of heel of the user and an elastic foot resistance member having attachment means thereon for detachably connecting said anklet assembly to one of the attachment means on said belt assembly.

2. An exercise device in accordance with claim 1, further including a harness assembly having two straps extendable over the shoulders of the user, a first end of each strap detachably connectable to the front of said belt assembly and a second end of each strap detachably connectable to the rear of said belt assembly.

3. An exercise device in accordance with claim 1, further including an anchor assembly having anchor means for placing on one side of a rigid structure, such as a door, and an elastic resistance member having attachment means thereon for detachably connecting said anchor assembly to one of the attachment means on said belt assembly.

4. An exercise device in accordance with claim 1, wherein said first and second layers of said belt assembly are formed of nylon or polypropylene.

5. An exercise device in accordance with claim 1, wherein said belt assembly attachment means includes a plurality of attachment loops and rings.

6. An exercise device in accordance with claim 1, wherein said closure means includes hook and loop fasteners, being integrally attached to nylon webbing of said belt assembly.

7. An exercise device in accordance with claim 1, wherein said hand strap includes fastening means for removably fastening said hand assembly to a hand of the user.

8. An exercise device in accordance with claim 1, wherein said foot strap includes fastening means for removably fastening said anklet assembly to a foot of the user.

9. An exercise device in accordance with claim 1, wherein said elastic hand resistance member includes an elastic cord and attachment clips at each end of said elastic cord, and means for securing said elastic cord to said attachment clips.

10. An exercise device in accordance with claim 1, wherein said elastic foot resistance member includes an elastic cord and attachment clips at each end of said elastic cord, and means for securing said elastic cord to said attachment clips.

11. An exercise device in accordance with claim 1, further including additional elastic hand resistance members having attachment means thereon for detachably connecting said hand assembly to one of the attachments on said belt assembly to provide increased resistance to the user.

12. An exercise device in accordance with claim 1, further including additional elastic foot resistance members having attachment means thereon for detachably connecting said foot assembly to one of the attachments on said belt assembly to provide increased resistance to the user.

13. An exercise device in accordance with claim 1, wherein said belt assembly is enclosed with an outer material layer made of nylon, dacron, cotton or cotton/polyester blend.

14. An exercise device in accordance with claim 3, wherein said anchor means include a rubber or plastic ball component.

* * * * *